US007518317B2

(12) United States Patent
Chou et al.

(10) Patent No.: US 7,518,317 B2
(45) Date of Patent: Apr. 14, 2009

(54) BACKLIGHT DRIVING AND CONTROL CIRCUIT WITH AN ISOLATED POWER FACTOR CORRECTION STRUCTURE

(75) Inventors: Chin-Wen Chou, Taipei Hsien (TW); Ying-Nan Cheng, Taipei Hsien (TW); Chin-Biau Chung, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 212 days.

(21) Appl. No.: 11/498,181

(22) Filed: Aug. 3, 2006

(65) Prior Publication Data

US 2008/0030146 A1 Feb. 7, 2008

(51) Int. Cl.
*H05B 37/02* (2006.01)

(52) U.S. Cl. ..... 315/276; 315/219; 315/224; 315/307

(58) Field of Classification Search ..... 315/224, 315/219, 307, DIG. 5, 274, 276, 277
See application file for complete search history.

(56) References Cited

U.S. PATENT DOCUMENTS 7,289,339 B2 * 10/2007 Chou et al. ..... 363/21.07

* cited by examiner

*Primary Examiner*—David Hung Vu
(74) *Attorney, Agent, or Firm*—Muncy, Geissler, Olds & Lowe, PLLC

(57) ABSTRACT

A backlight driving and control circuit with an isolated power factor correction structure includes a power stage for providing a power supply; a driver stage having a first power factor correction unit for correcting the power factor of the power supply and outputting DC power; an inverter for converting a middle-voltage DC power into a high-voltage power output and driving the operation of a backlight light emitting component; and a control/dimming stage having a second power factor correction unit, a DC transformer unit, and an AD board installed at a secondary winding of the DC transformer unit and grounded jointly with the inverter. With the invention, the power factor correction unit can be electrically isolated from the power stage, and the AD board can directly control/dim the inverter of the driver stage to change the operating status of the backlight light emitting component.

9 Claims, 2 Drawing Sheets

BACKLIGHT DRIVING AND CONTROL CIRCUIT WITH AN ISOLATED POWER FACTOR CORRECTION STRUCTURE

FIELD OF THE INVENTION

The present invention relates to a driving and control circuit of an electronic load, and more particularly to a backlight driving and control circuit with an isolated power factor correction structure.

BACKGROUND OF THE INVENTION

Referring to FIG. 1 for a prior art driving and control circuit structure for controlling a backlight component of a display device (such as a liquid crystal display device), an alternate current (AC) from a power terminal 10 is filtered and rectified and supplied to two parts respectively. The first part is provided for driving the operation of a load which is a light emitting component such as a cold cathode fluorescent lamp (CCFL), and the second part is provided for supplying electric power to a control circuit such as a control circuit board or an AD board.

The circuit structure of the first part comprises: a first power factor correction unit 11 connected to a power terminal 10 for correcting the power factor of a power supply and outputting a DC power (a middle-voltage DC power approximately equal to 380~400V), and an inverter 12 (which usually includes a PWM control circuit and an inverter for converting the middle-voltage DC power into a high-voltage power output and driving a backlight light emitting component 18 such as a cold cathode fluorescent lamp). The circuit structure of the second part comprises: a second power factor correction unit 13 connected to a power terminal 10 for correcting the power factor of a power supply, a DC/DC transformer unit 14 (which is usually an isolation transformer whose primary and secondary windings are separated from each other and not grounded jointly, and the primary winding of the DC transformer unit 14, the first power factor correction unit 11 and second power factor correction unit 13 are grounded together), and an AD board 15 installed at a secondary winding of the DC transformer unit 14 and coupled to an inverter 12 of the foregoing driver stage through an isolation optical coupler 16, 17 for controlling or correcting the inverter 12 and changing the operating status of a backlight light emitting component 18.

Since the prior art inverter 12 and the aforementioned first power factor correction unit 11 have the circuit structures that are grounded jointly (or grounded to a high-voltage power supply), and the AD board 15 and the inverter 12 are isolation circuit structures that are not grounded jointly. Therefore, a control signal (such as an ON/OFF control signal for controlling the ON/OFF of the backlight or dimming the brightness of the backlight) in the AD board 15 cannot be connected directly to the inverter 12, but it is necessary to use an isolation optical coupler 16, 17 to control the inverter 12 (such as dimming the backlight component and controlling the ON/OFF of the backlight component). Such method of using the isolation optical coupler 16, 17 to transmit control signals definitely will increase the number of optical couplers. On the other hand, since the power factor correctors (including the first power factor correction unit 11 and the second power factor correction unit 13) and the power terminal are grounded jointly, and the primary and secondary windings are not isolated from each other, it will jeopardize the safety of users.

SUMMARY OF THE INVENTION

A primary objective of the present invention is to overcome the foregoing shortcomings and avoid the existing deficiencies by providing a safe backlight driving and control circuit.

To achieve the foregoing objective of the present invention, a feasible technical solution is provided, and the invention relates to a backlight driving and control circuit with an isolated power factor correction structure, wherein the power factor correction unit can adopt an isolation transformer, such that the primary winding connected to a power supply is isolated from the secondary winding in the power factor correction unit to constitute an electric isolation for avoiding power conflicts of the power factor correction unit and the inverter or avoiding the risk of electric shocks.

Another objective of the present invention is to provide a backlight driving and control circuit capable of controlling an inverter directly without requiring an isolation optical coupler (such as dimming and controlling the ON/OFF of the backlight component) to change the operating status of the backlight light emitting component.

To achieve the foregoing objectives of the present invention, an electric isolation applied for jointly grounding the inverter and the AD board forms an electric isolation with a front-end power factor correction unit, such that the inverter can be connected directly to the AD board of the control/dimming stage, and the AD board does not need an isolation optical coupler for controlling the inverter (such as dimming the backlight component and controlling the ON/OFF of the backlight component) to change the operating status of the backlight light emitting component.

DETAILED DESCRIPTION OF THE PREFERRED EMBODIMENTS

To make it easier for our examiner to understand the technical characteristics, objective and performance of the invention, we use a preferred embodiment together with the attached drawings for the detailed description of the invention.

Figure 1:
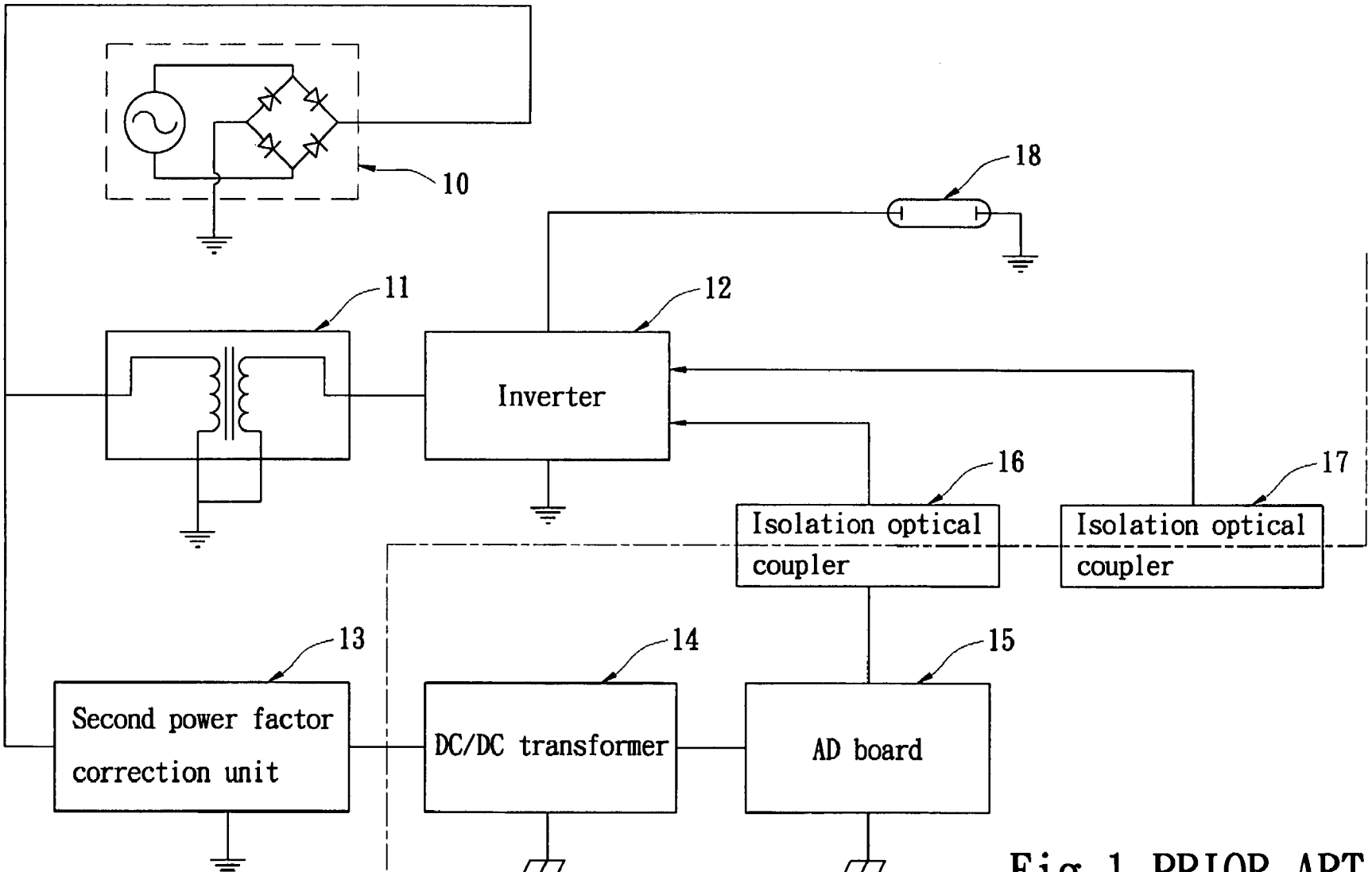
Fig. 1 PRIOR ART
FIG. 1 is a circuit diagram of a backlight driving and control circuit with a power factor correction structure in accordance with a prior art.
Figure 2:
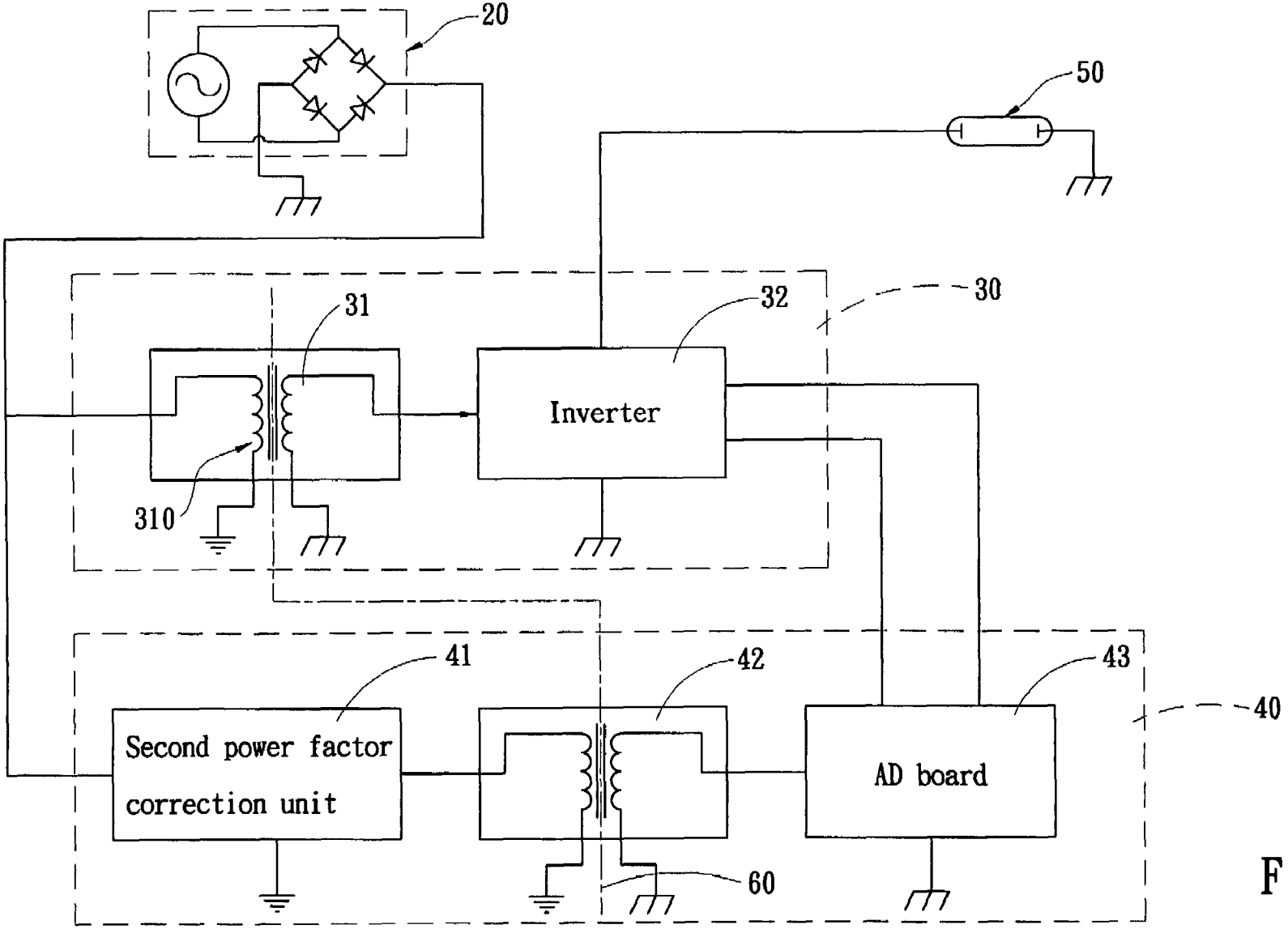
FIG. 2 is a circuit diagram of a preferred embodiment of the present invention.

Referring to FIG. 2, a circuit structure of a preferred embodiment of the present invention comprises:

a power stage 20, for providing a power supply and converting utility power (AC power) into DC power required by appliances, wherein the electricity specification of the utility power varies with different countries (such as AC-110V or AC-220V), and the power stage 20 generally includes an electromagnetic interference (EMI) wave filter unit and a bridge rectifier made of diodes for filtering and rectifying the AC power and outputting full-wave/half-wave DC power (wherein the EMI wave filter unit may be installed depending on the electric power specifications of different countries);

a driver stage 30, having a first power factor correction unit 31, for correcting a power factor of the power supply and outputting a middle-voltage DC power approximately equal to 380~400V and an inverter 32 for converting the middle-voltage DC power into a high-voltage power output and driving the operation of the backlight light emitting component 50; and a control/dimming stage 40, having a second power factor correction unit 41, a DC transformer unit 42, and an AD board 43, wherein the second power factor correction unit 41 is provided for correcting the power factor of the power supply and outputting a DC power, and the DC transformer unit 42 converts the power to a low-voltage (such as 5V, 12V, or 24V) DC power and supplies the required DC power to the AD board; wherein the AD board 43 is connected to a secondary winding of the DC transformer unit and defines a circuit structure jointly grounded with the inverter 32, for issuing a dimming control signal or an ON/OFF control signal to directly control/correct an inverter 32 of the driver stage 30 to change the operating status of the light emitting component 50 (such as controlling the brightness or the ON/OFF of the light emitting component 50).

The first power factor correction unit 31 could be a boost or trim circuit structure depending on actual needs, and the first power factor correction unit 31 is generally connected to a variable resistor or a fixed resistor to obtain a voltage reference value, such that the first power factor correction unit 31 corrects the power factor of the power supply based on this voltage reference value, and the core of an inverter 32 is an inverter for converting the voltage of a full-wave/half-wave DC power depending on the specification of the light emitting component 50 to output and drive the voltage required by the operation of the light emitting component 50. If the cold cathode fluorescent lamp (CCFL) is used as the light emitting component 50, then it is necessary to use an inverter with a high-voltage output.

In general, an inverter installed between the first power factor correction unit 31 and the inverter 32 further includes a pulse-width modulation (PWM) controller (not shown in the figure), and the PWM controller and the power factor controller are usually integrated into a signal control IC, and users can use the AD board 43 to issue a dimming signal or an ON/OFF control signal for dimming or controlling the ON/OFF of the light emitting component 50 to change the operating status of the backlight light emitting component 50.

From the isolation line 60 indicated in FIG. 2, it is known that the first power factor correction unit 31 and the second power factor correction unit 41 define a circuit structure grounded jointly and the power stage 20 grounded to the earth forms an electric isolation structure, and the inverter 32 and the AD board 43 are grounded jointly (either the housing is grounded or they are grounded to the earth) to define a circuit structure grounded jointly with the power stage 20, so as to avoid power conflicts among the first power factor correction unit 31, the second power factor correction unit 41 and the power stage 20, and avoid power conflicts between the power supply and the inverter 32 coupled to the secondary winding or avoid the risk of electric shocks.

In a preferred embodiment of the present invention, the first power factor correction unit 31 and the DC transformer unit 42 adopt an isolation transformer, and an isolation transformer 310 of the first power factor correction unit 31 and the primary and secondary windings of the DC transformer unit 42 are isolated from each other to define a circuit structure not grounded jointly, and the second power factor correction unit 41 and the primary winding of the DC transformer unit 42 are grounded jointly (or the power supply is grounded) with the primary winding of the first power factor correction unit 31. With the design of electric isolation and circuit structure grounded jointly, the AD board 43 of the control/dimming stage 40 and the inverter 32 of the driver stage 30 define a circuit structure grounded jointly (the housing is grounded or they are grounded to the earth), such that the AD board 43 does not need an optical coupler to directly issue a dimming control signal or an ON/OFF control signal to the inverter 32 for dimming and controlling the ON/OFF of the light emitting component 50 to change the operating status of the backlight light emitting component 50.

While the invention has been described by means of specific embodiments, numerous modifications and variations could be made thereto by those skilled in the art without departing from the scope and spirit of the invention set forth in the claims.

What is claimed is:

1. A backlight driving and control circuit with an isolated power factor correction structure, for driving and controlling the operation of a light emitting component, comprising:

a power stage, for providing a power supply;

a driver stage, having a first power factor correction unit for correcting a power factor of said power supply and outputting a DC power and an inverter for converting said DC power into a high-voltage power output and driving the operation of said light emitting component, and said inverter and said first power factor correction unit constitute a circuit structure of an electric isolation without being grounded jointly; and a control/dimming stage, having a second power factor correction unit, a DC transformer unit, and an AD board, and said second power factor correction unit, said primary winding of said DC transformer unit and said first power factor correction unit constitute a circuit structure grounded jointly, and said power stage forms a circuit structure of an electric isolation, and said AD board is installed at a secondary winding of said DC transformer unit and constitute a circuit structure jointly grounded with said inverter, for directly controlling and dimming said inverter of said driver stage, and dimming said light emitting component and controlling the ON/OFF of said light emitting component.

2. The backlight driving and control circuit with an isolated power factor correction structure of claim 1, wherein said light emitting component is a cold cathode fluorescent lamp (CCFL).

3. The backlight driving and control circuit with an isolated power factor correction structure of claim 1, wherein said first power factor correction unit includes an isolation transformer, and primary and secondary windings of said isolation transformer are isolated from each other to define a circuit structure not jointly grounded.

4. The backlight driving and control circuit with an isolated power factor correction structure of claim 3, wherein said primary winding of said isolation transformer of said first power factor correction unit keeps an electric isolation structure not grounded jointly with said power stage, and a secondary winding of said isolation transformer and said inverter define a circuit structure jointly grounded.

5. The backlight driving and control circuit with an isolated power factor correction structure of claim 1, wherein said DC transformer unit is an isolation transformer, and primary and secondary windings of said DC transformer unit are isolated from each other to define a circuit structure not jointly grounded.

6. A backlight driving and control circuit with an isolated power factor correction structure, comprising:

a power stage, for providing a power supply;

a driver stage, having a first power factor correction unit and an inverter, for converting said power supply into a high-voltage power output to drive a load; and a control/dimming stage, having a second power factor correction unit, a DC transformer unit, and an AD board, and said AD board controlling said inverter and correcting or controlling the operation of said load, wherein said first power factor correction unit and said second power factor correction unit define a circuit structure grounded jointly, and said power stage grounded to the earth defines an electric isolation structure, and said inverter, said AD board and said power stage define a circuit structure grounded jointly.

7. The backlight driving and control circuit with an isolated power factor correction structure of claim 6, wherein said first power factor correction unit includes an isolation transformer, and primary and secondary windings of said isolation transformer are isolated from each other to define a circuit structure not grounded jointly.

8. The backlight driving and control circuit with an isolated power factor correction structure of claim 7, wherein said primary winding of said isolation transformer of said first power factor correction unit and said power stage maintain an electric isolation structure without being grounded jointly, and said secondary winding of said isolation transformer is a circuit structure grounded jointly with said inverter.

9. The backlight driving and control circuit with an isolated power factor correction structure of claim 6, wherein said DC transformer unit is an isolation transformer, and said second power factor correction unit, said primary winding of said DC transformer unit and said first power factor correction unit constitute a circuit structure grounded jointly and define a circuit structure having an electric isolation with said power stage.

* * * * *